US007976485B2

(12) United States Patent
Huang

(10) Patent No.: US 7,976,485 B2
(45) Date of Patent: Jul. 12, 2011

(54) MASSAGER MOVES ON UNDULATED TRACK

(76) Inventor: Xiang-Yi Huang, Nan-Tou County (TW)

( * ) Notice: Subject to any disclaimer, the term of this patent is extended or adjusted under 35 U.S.C. 154(b) by 1082 days.

(21) Appl. No.: 11/802,790

(22) Filed: May 25, 2007

(65) Prior Publication Data

US 2008/0294076 A1 Nov. 27, 2008

(51) Int. Cl.
*A61H 7/00* (2006.01)

(52) U.S. Cl. ..... 601/98; 601/99; 601/100; 601/101; 601/103

(58) Field of Classification Search ..... 601/49, 601/56–60, 86, 90–95, 98–103, 115, 116
See application file for complete search history.

(56) References Cited

U.S. PATENT DOCUMENTS

| | | | | |
|---|---|---|---|---|
| 4,757,808 | A | 7/1988 | Effler, Jr. et al. | |
| 6,402,709 | B1 | 6/2002 | Wu | |
| 6,551,259 | B1 | 4/2003 | Wu | |
| 6,837,861 | B2 | 1/2005 | Lin | |
| 7,128,721 | B2 | 10/2006 | Ferber et al. | |
| 7,160,261 | B1 | 1/2007 | Huang | |
| 7,419,475 | B2 | 9/2008 | Ferber et al. | |
| 7,470,242 | B2 | 12/2008 | Ferber et al. | |
| 7,597,669 | B2 * | 10/2009 | Huang | 601/86 |
| 2002/0193713 | A1 * | 12/2002 | Lee | 601/99 |
| 2005/0010143 | A1 * | 1/2005 | Kim | 601/99 |
| 2005/0020946 | A1 * | 1/2005 | Kim | 601/15 |
| 2005/0245851 | A1 | 11/2005 | Ferber et al. | |
| 2005/0256434 | A1 * | 11/2005 | Luo | 601/86 |
| 2006/0211962 | A1 | 9/2006 | Ferber et al. | |
| 2007/0027412 | A1 | 2/2007 | Li et al. | |
| 2007/0060851 | A1 | 3/2007 | Ferber et al. | |
| 2007/0106185 | A1 | 5/2007 | Ferber et al. | |
| 2008/0262398 | A1 | 10/2008 | Ferber et al. | |
| 2008/0306416 | A1 | 12/2008 | Ferber et al. | |
| 2009/0093742 | A1 | 4/2009 | Ferber et al. | |

FOREIGN PATENT DOCUMENTS

| | | |
|---|---|---|
| CN | 2803347 Y | 8/2006 |

* cited by examiner

*Primary Examiner* — Justine R Yu
*Assistant Examiner* — Valerie Skorupa
(74) *Attorney, Agent, or Firm* — Eckert Seamans Cherin & Mellott, LLC; Stephen A. Bucchianeri, Esquire

(57) ABSTRACT

The present invention is to provide a massager moves on a pair of undulated tracks. The massager comprises a massaging core 1, and a base 2, which includes a tow unit 3, a shank 4, a pair of tracks 51 and a pair of undulated tracks 52. The tow unit 3 is slided along the tracks 51, the tow unit is connected to the massaging core 1 by a pivotal axle. And the massaging core 1 is further guided to move along the undulated tracks 52. Tow unit 3 meshed with the shank 4 can be driven by a driving unit and a transmission unit, thereby, the tow unit 3 can be glided along the shank 4 and the track 51. The massaging core 1 connected to a tow unit 3 can slide along a pair of undulated tracks similar to waist, back, and neck portions of human body.

7 Claims, 4 Drawing Sheets

MASSAGER MOVES ON UNDULATED TRACK

FIELD OF THE INVENTION

The present invention is related to an appliance guarantee of user's health status, particularly to a massager with tracks.

DESCRIPTION ABOUT PRIOR ARTS

As we pursue a businesslike working hours to bring a crowd of workers being bustled off on duty through A.M 9:00 to P.M 5:00 into harmony, persons go after finding anything as an intense support for eliminating headaches, backaches etc. Massagers are thus developed to give some relief to persons working through time card duration; such as head massagers, feet massagers, electro magnetic massagers, and back massagers are promoted on the market far and wide. Many back massagers equipped with electro magnetic hammer secured to back slate, whose electro magnetic vibrations are manipulated according to pre-programmed computer programs. Or a single massaging head equipped with a vibrator can be used to massage an affected portion of human body. However, many affected portions of human body are not accessible by such massagers, which could not relieve a user's ache all over with fatigue by mimicking a massagist.

To achieve a better massage effect, persons skilled in the art have provided improved massagers, such as published CN2803347Y entitled "massager moves on back portion of human body" to Huang, Chi-Ming on Aug. 9, 2006; Huang disclosed a massager can differentiate back portion from others of human body to run massaging cycles and get their rhythms. This kind of running massager may animate whole party of a workplace as they adopt it to give some relief by themselves.

Drawbacks still exists in the massagers of prior arts as following:

1. When massaging, get a fix for slide tracks route to and fro over a rectilinear path, still may be out of contact with some affected portions of human body such as waist, back portions, even leave neck portion aching for a long time.
2. A massaging core usually is activated by a shank, which is extended from a motor, a transmission unit inside the massaging core is, therefore, activated to rotate the massaging core. Not only a series of trivial steps (labor cost) is required to set up such a massager, but also a motor (material cost) with noise added to massager must consume more electricity power.
3. Massaging core could not route to and fro over a rise and fall path, further could not reach to a neck portion.

SUMMARY OF THE INVENTION

Accordingly, the present invention is to provide a sliding massager moves on a pair of undulated tracks comprising a massaging core 1, and a base 2; the base 2 is wrapped up by a soft lining as a bumper, characterized in that: a tow unit 3, a shank 4, a pair of tracks 51, and a pair of undulated tracks 52; the tow unit 3 is driven along the pair of tracks 51, the tow unit 3 is connected to the massaging core 1 by a pivotal axle, whereby the massaging core 1 can be driven along the pair of undulated tracks 52.

A sliding massager moves on a pair of undulated tracks according to claim 1 wherein said tracks 51 and undulated tracks 52 are disposed on two parallel slates 5 opposite to each other, but the tracks 51 are in linear shape, while the undulated tracks 52 conformed to contours of waist or back portions of human body; the undulated tracks 52 can elevate the massaging core to exert force along a slope of neck portion of a poised head.

A sliding massager moves on a pair of undulated tracks according to claim 1 wherein said shank 4 secured to the base 2, a sliding gear 41 with threads inwardly formed around an inner surface relative to threads formed on a peripheral surface of the shank 4, whereby the sliding gear 41 fits over the shank 4, which fits through the tow unit 3, and the sliding gear 41 is located within the tow unit 3; thereby the tow unit 3 fits on and moves along the shank 4 with a first set of gears meshed with the sliding gear 41 of the shank 4, said first set of gears is driven by a motor 6; two lateral sides of the tow unit 3 are bended and extended downward to form tabs 30 respectively, said tabs 30 are embedded in the tracks 51 respectively, thereby the tow unit 3 can be driven to slide along the tracks 51; two sliding blocks 11 are shaped on both lateral portions of the massaging core 1.

A sliding massager moves on a pair of undulated tracks according to claim 1 wherein said first set of gears includes a first pair of gears 31 meshed with a first worm 61 at a first end of the motor, and a second pair of gears 32 meshed with the first pair of gears 31, and the first pair of gears 31 installed inside the massaging core 1, the second pair of gears 32 installed inside the tow unit 3.

A sliding massager moves on a pair of undulated tracks according to claim 1 wherein the massaging core 1 equipped with a dual headed worm motor 6, a first worm 61 at a first end of the motor 6 drives the first pair of gears 31, a second worm 62 at a second end of the motor 6 drives the second pair of gears 32, in turn, the second pair of gears 32 drives a massaging head 12 of the massaging core 1 to rotate.

A sliding massager moves on a pair of undulated tracks according to claim 1 wherein an axial line of said dual headed worm motor 6 is perpendicular to an axial line of the first pair of gears 31, said tow unit 3 is connected to the massaging core 1 by a pivotal axle, which is in alignment with an axial line of the second pair of gears 32.

A sliding massager moves on a pair of undulated tracks according to claim 1 wherein the massaging core 1 has two massaging heads 12 relative to and coupled with two sets of second pair of gears 32 respectively, the second pair of gears 32 includes a gear speed reducer 13 meshed with a second worm 62 at a second end of the motor 6, and a transmission gear 14 meshed with the gear speed reducer 13 as well as secured to a shaft 120 of the massaging head 12.

A sliding massager moves on a pair of undulated tracks according to claim 1 wherein said base 2 includes an upper housing 21 and a lower housing 22, said shank 4 and slate 5 are secured to the lower housing 22 in parallel, an opening 210 of the upper housing 21 is opened up for receiving the massaging core 1 therein, the massaging heads 15 of massaging core 1 can be exposed out of the opening 210.

DETAILED DESCRIPTION OF THE PREFERRED EMBODIMENTS OF THE INVENTION

Detailed description of the invention is described according to the appended drawings hereinafter.

Figure 1:
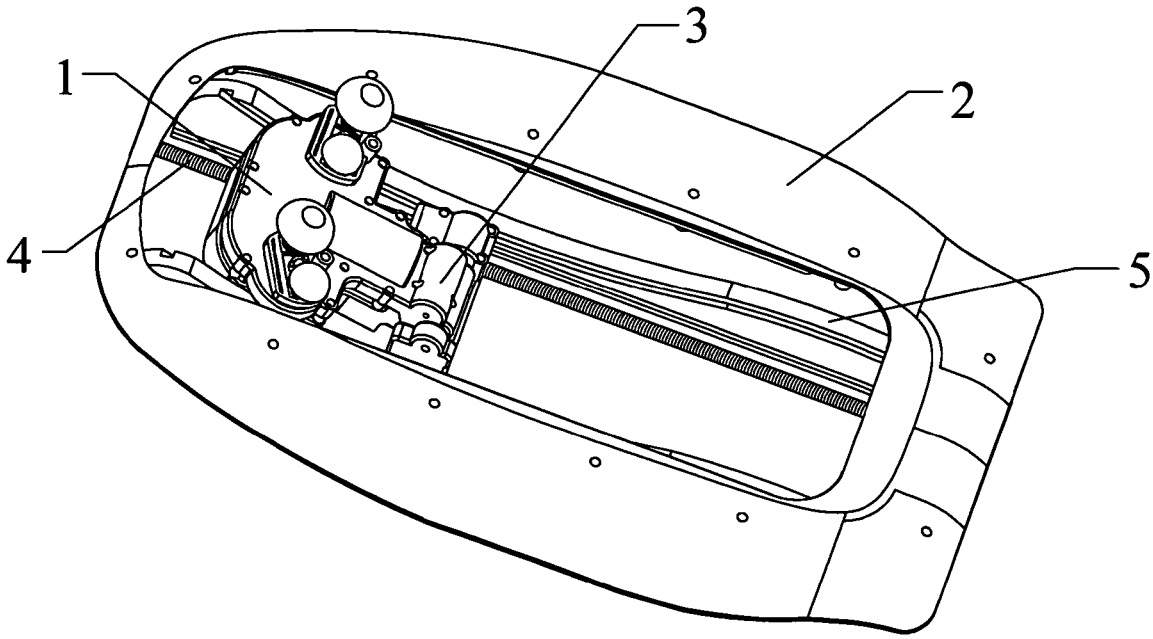
FIG. 1: shows a perspective view of the present invention.
Figure 2:
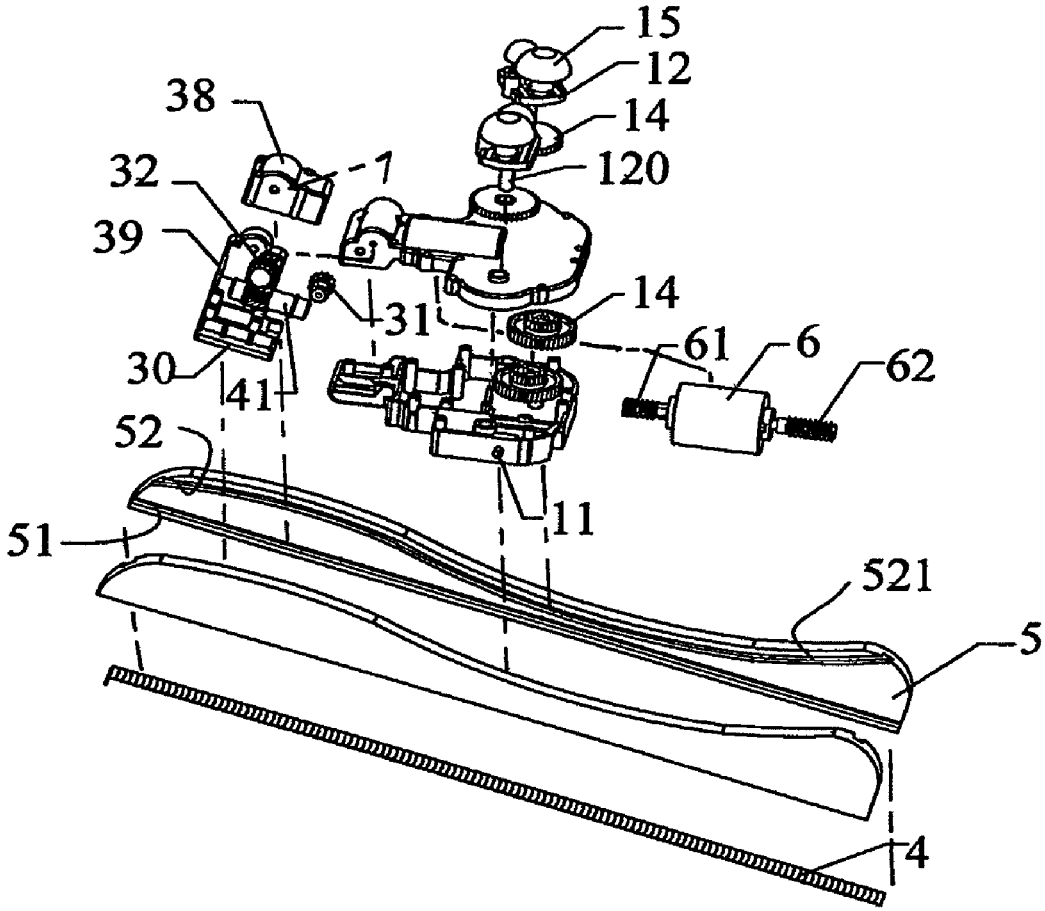
FIG. 2: shows an exploded view of the present invention in part.
Figure 3:
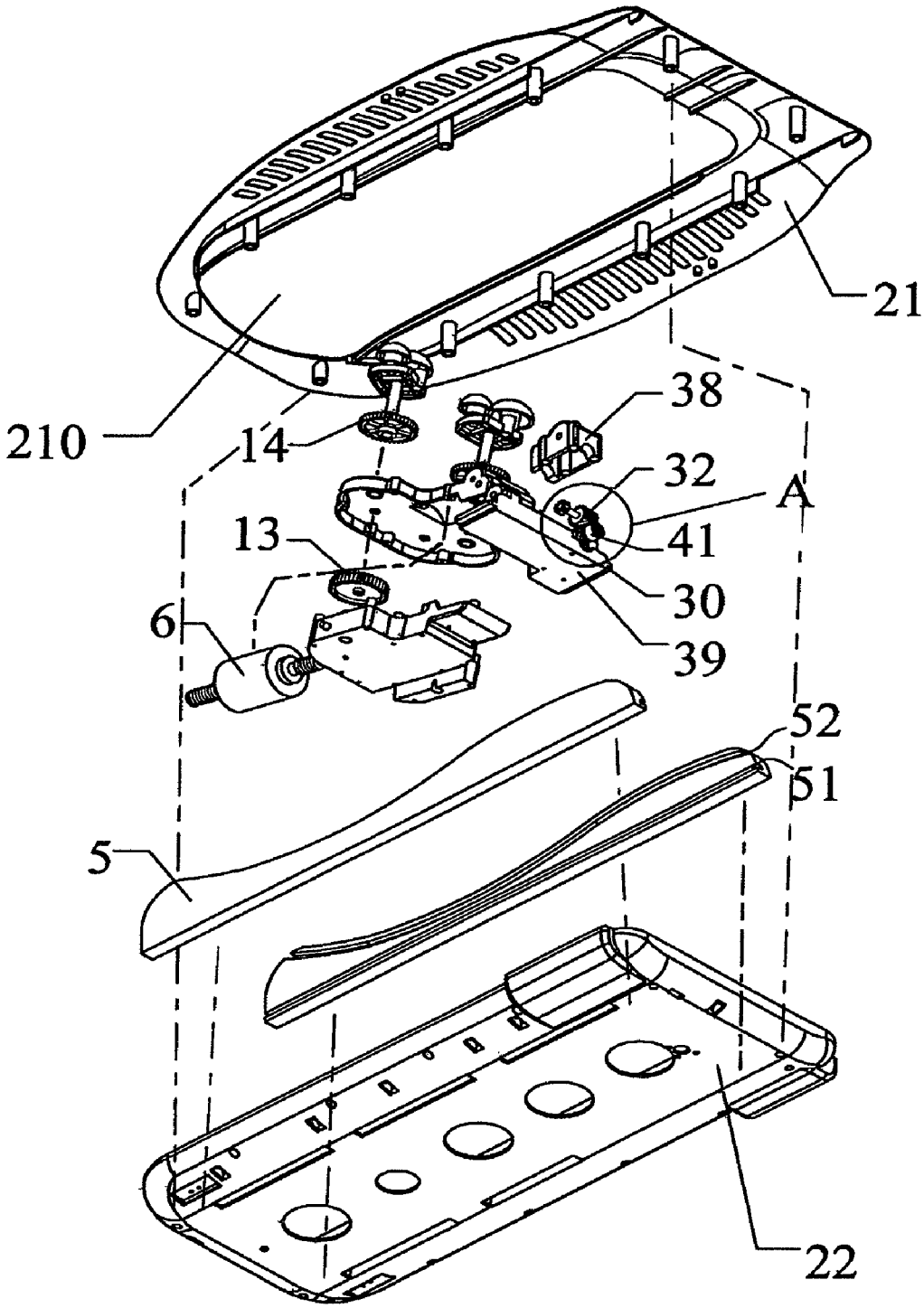
FIG. 3: shows another exploded view of the present invention.
Figure 4:
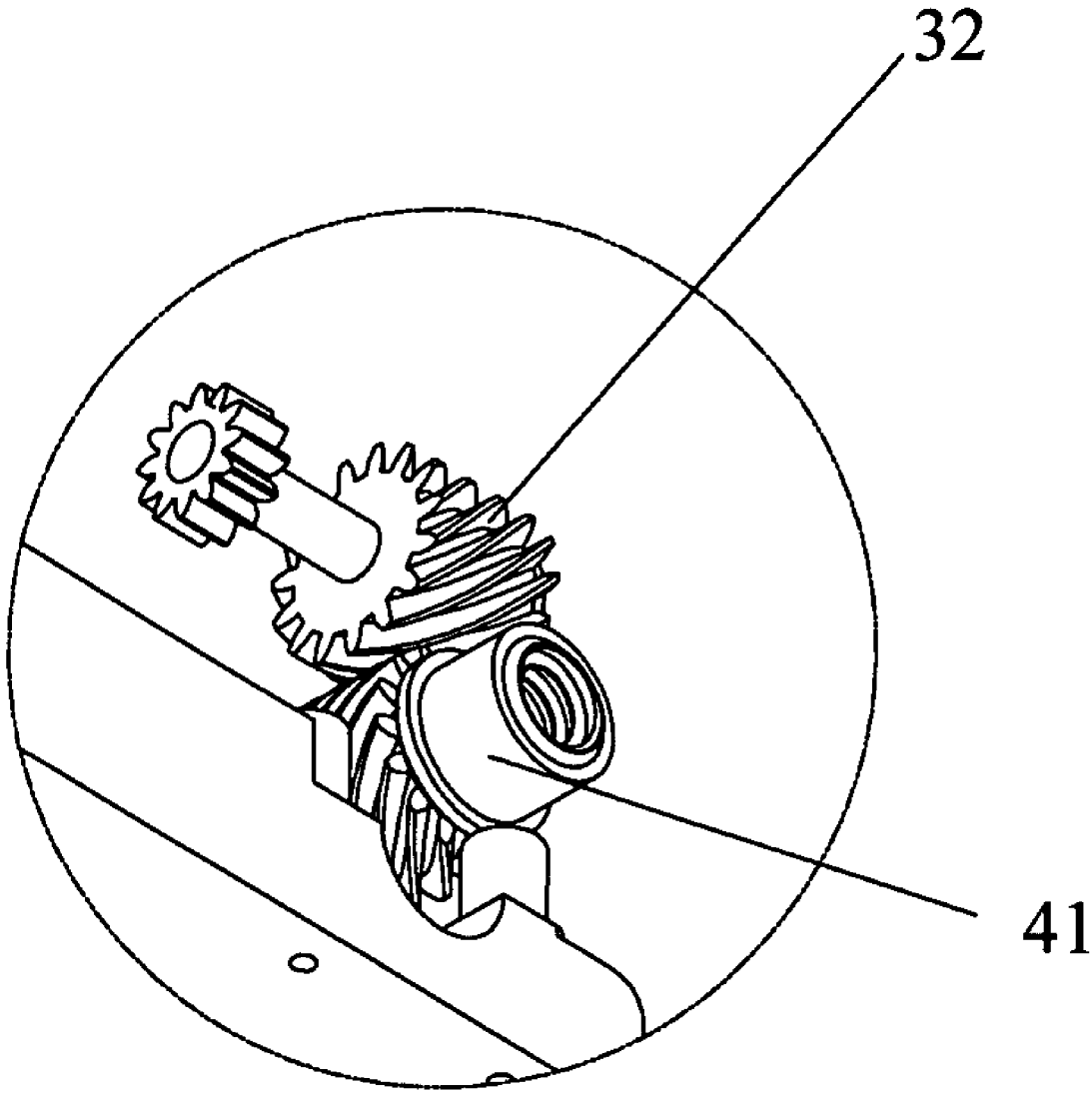
FIG. 4: show an enlarged view of a sliding gear meshed with a second pair of gears circled and indicated by character A of FIG. 3.

As shown in FIG. 1, a massager of the invention comprising a base 2, a massaging core 1, a tow unit 3, a shank 4 and a slate 5. Pairs of track 51 and undulated tracks 52 are disposed on the slate 5 opposite to each other. Principle of massaging is derived from a massaging force exerted by massaging heads as follows: the tow unit 3 is first meshed with the shank 4, and then being driven by a driving unit (i.e. motor 6 and worms 61,62) and a transmission unit (i.e. first pair of gears 31), the tow unit 3 can slide along the shank 4 and the tracks 51. Thereby, the tow unit 3 connected to the massaging core 1 by a pivotal axle can be guided along a pair of undulated tracks 52; meanwhile, massaging heads can exert force to affected portions of human body.

Specifically speaking, as exploded views 2-4 show, the base 2 of the present invention includes an upper housing 21, a lower housing 22, they are assembled together as a whole by riveting, screwing, adhering, or any suitable means. An opening 210 is formed through a top end of the upper housing 21 for projecting out two massaging heads 15 therefrom. Two slates 5 are in parallel installed to the lower housing 22, on inner surfaces of both two slates opposite to each other, each is formed with a track 51 extended inward along bottom ends of the slates 5, and a undulated track 52 extended inward along top ends of the slates 5. The track 51 is shaped in a linear shape, while the undulated track 52 is shaped in a rise and fall curve similar to contours of back portion, waist portion, and neck portion of human body. Thereby the pair of undulated tracks 52 have a smooth slope for elevating the massaging core 1 in position to massage a smooth slope 521 along the neck portion. The shank 4 is secured between two slates 5 in parallel at a gap to an upper surface of the lower housing 22 so as to pass through the tow unit 3.

The tow unit 3 has a lower portion 39, both lateral sides of the lower portion 39 are bended and extended downward to form a pair of tabs 30. The tab 30 can be embedded in the track 51 of said slates 5. Said shank 4 has threads thoroughly distributed over a peripheral surface, and the shank 4 is fixed above one lateral side of said lower portion 39. An upper portion 38 of the tow unit 3 is assembled to the lower portion 39 of the tow unit 3 to form a cannular portion for receiving the shank 4 passing through between them. A sliding gear 41 fit over the shank 4 by threads formed around an inner surface to mesh with the threads formed thoroughly over the peripheral surface of the shank 4. Inner threads of the sliding gear 41 is relative to the threads on the peripheral surface of the shank 4, the sliding gear 41 is projected outward around an outer surface opposite to the inner threads. A second pair of gears 32 mounted inside the upper portion 38 of the tow unit 3 to mesh with the sliding gear 41 of the shank 4. An axial line of the second pair of gears 32 is perpendicular to the peripheral threads of the shank 4. The second pair of gears 32 is further meshed with a first pair of gears 31, which is installed in parallel to the shank 4. The first, second pairs of gears 31,32 are assembled together to form a first set of gears. The first pair of gears 31 is installed on the massaging core 1. A first worm 61 at a first end of a dual headed worm motor 6 drives the first pair of gears 31. As a result, the dual headed worm motor 6 first drives the first pair of gears 31 to rotate, and then the first pair of gears 32 drives the second pair of gears 32 to rotate; finally, the second pair of gears 32 drives the sliding gear 41 on the shank 4 to rotate. Therefore, the sliding gear 41 will slide along the peripheral surface of the shank 4 by meshing with their threads. Further, the sliding gear 41 is located within the tow unit 3, which is glided smoothly along the shank 4. Thereby, the tow unit 3 is glided along the shank 4 in position by two tabs 30 embedded in the tracks 51 of said slates 5.

Meanwhile, a second worm 6 at a second end of the motor 6 drives the second pair of gears 32. The second pair of gears 32 includes a gear speed reducer 13 meshed with the second worm 62; their axial lines are perpendicular to each other. A transmission gear 14 installed to a distal end of a shaft 120 of the massaging head 12 is meshed with the gear speed reducer 13, whereby the massaging head 12 can be driven to rotate for massaging. Due to the shank 4 is passed through the massager, therefore, a lower portion of the massaging core 1 should be formed with a trough to conform to the peripheral surface of the shank and avoid from being incompatible with the shank 4.

A front end of the massaging core 1 is connected to a tow unit 3 by a pivotal axle, further the first pair of gears 31 of the first set of gears are installed on the front end of the massaging core 1. Thereby, the first pair of gears 31 meshed with the first worm 61 at the first end of the motor 6 carries out a transmission performance, which is further transferred to the second pair of gears 32. Cylindrical sliding blocks 11 are shaped at both lateral sides of the massaging core 1, the sliding blocks 11 are placed inside the undulated track 52. Thereby, locations of the massaging core 1 must be regulated between the slates 5; the massaging core 1 slides along the undulated track 52 guided by the tow unit 3.

Since the undulated track 52 is shaped in a rise and fall curve, once the massager is applied to a different affected portion, the massaging core 1 and the tow unit 3 opposite to each other will be rotative together around the pivotal axle between them. Even the first pair of gears 31 inside the massaging core 1 and the second pair of gears 32 opposite to each other will be rotative together. To ensure the first pair of gears 31 meshed with the second pair of gears 32, the pivotal axle between the tow unit 3 and the massaging core 1 aligns the axial line of the second pair of pinions 32 at a same axial line.

After adoption of the massaging core as mentioned above, the massager can be reclined against a back of couch or sofa, and then a user's back portion can be reclined upon the base of the massager, where the back portion is exposed at an opening of the base, the massaging core is guided by a tow unit to slide along the pair of undulated tracks, which is similar to contours of back, waist, and neck portions of human body for massaging.

Embodiments of the present invention can achieve advantages as follows:

Massaging core 1 of the massager can be guided by a tow unit 3 to slide along a pair of undulated tracks proximately proceed with contours of waist, back portions of human body, whereby the affected portions includes user's back or waist can be relived from aches, further the massager can be manipulated to reach to a neck portion of the human body.

The invention claimed is:

1. A body massager comprising:

a base structured to accommodate a portion of a body of a user;

a linear track disposed within the base;

an undulated track disposed within the base;

a tow unit oriented in the base and operatively coupled thereto for translation with respect to the base along the linear track; and a massaging core comprising a rigid housing pivotably coupled to the tow unit and cooperatively engaged with the undulated track such that a portion of the rigid housing for translation translates with respect to the base only along the undulated track and another portion of the rigid housing translates with respect to the base only along the linear track, the massaging core further comprising:

a number of massaging members structured to provide a massaging effect to the portion of the user's body; and a motor supported thereon, the motor having an output shaft extending therefrom and driven thereby, the output shaft being operatively coupled to the base to translate the tow unit and massaging core with respect to the base;

wherein the motor comprises a dual headed worm gear motor having a first worm gear at a first end of the motor operatively coupled to the base and a second worm gear at a second end of the motor operatively coupled to the number of massaging members.

2. The body massager of claim 1 wherein the output shaft is operatively coupled to the number of massaging members.

3. The body massager of claim 2 wherein the output shaft comprises a first end extending from a side of the motor and a second end extending from an opposite side of the motor, the first end of the output shaft being operatively coupled to the base and the second end of the output shaft being operatively coupled to the number of massaging members.

4. The body massager of claim 1 wherein the base comprises a threaded shank secured therein and wherein the output shaft is operatively coupled to the threaded shank.

5. The body massager of claim 1 wherein the operative coupling between the first worm gear and the base is accomplished via a first set of gears meshed with the first worm gear and a second set of gears meshed with the first set of gears; and wherein the first set of gears is disposed within the massaging core and the second set of gears is disposed within the tow unit.

6. The body massager of claim 1 wherein the undulated track is structured to conform to the contours of the waist or back portions of a body of a user and the undulated track is further structured to elevate the massaging core to exert force along a slope of the neck portion of a body of a user.

7. The body massager of claim 1 wherein the base further includes another undulated track disposed opposite the undulated track to form a pair of undulated tracks and wherein the massaging core cooperates with the pair of undulated tracks for translation with respect to the base along the pair of undulated tracks.

* * * * *